US006340507B2

(12) United States Patent
Holguin

(10) Patent No.: US 6,340,507 B2
(45) **Date of Patent: *Jan. 22, 2002**

(54) SELF-SECURING POMPON

(76) Inventor: Sylvia Gomez Holguin, 1600 Gladys Dr., Las Cruces, NM (US) 88001

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/221,200

(22) Filed: Dec. 22, 1998

Related U.S. Application Data

(60) Provisional application No. 60/068,614, filed on Dec. 22, 1997.

(51) Int. Cl.[7] ..... D04D 7/06
(52) U.S. Cl. ..... 428/4; 428/5; 28/147
(58) Field of Search ..... 428/4, 5, 101, 428/66.5; 223/46; 28/147

(56) References Cited

U.S. PATENT DOCUMENTS

| | | | | | |
|---|---|---|---|---|---|
| 1,047,703 | A | | 12/1912 | Rapson | |
| 1,395,033 | A | | 10/1921 | Bowers | |
| 2,646,796 | A | | 7/1953 | Scholl | |
| 2,725,670 | A | | 12/1955 | Hodes | |
| 2,787,862 | A | | 4/1957 | Hoeflich | |
| 2,810,977 | A | | 10/1957 | Barry | |
| 3,560,313 | A | | 2/1971 | Herkimer | |
| 4,201,806 | A | | 5/1980 | Cole | |
| 4,369,215 | A | | 1/1983 | Offen et al. | |
| 4,806,396 | A | * | 2/1989 | Pratt et al. | 428/4 |
| 5,997,966 | A | * | 12/1999 | Sadur | 428/4 |

* cited by examiner

*Primary Examiner*—Deborah Jones
*Assistant Examiner*—Abraham Bahta
(74) *Attorney, Agent, or Firm*—Jeffrey D. Myers

(57) ABSTRACT

The pompon comprises a loop of material attached to strands of material such that a body part may be placed through to loop and so secured to the person. An attention-attracting sports and entertainment pompon and a method of using such pompon. The pompon allows the user to display the pompon without interfering with the user's other activities.

4 Claims, 1 Drawing Sheet

SELF-SECURING POMPON

CROSS-REFERENCE TO RELATED APPLICATIONS

This application is a continuation-in-part application of U.S. patent application Ser. No. 60/068,614, entitled Finger Poms, to Silvia Gomez, filed on Dec. 22, 1997, and the specification thereof is incorporated herein by reference.

BACKGROUND OF THE INVENTION

1. Field of the Invention (Technical Field)

The present invention relates to attention-attracting sports and entertainment devices, more particularly to pompons.

2. Background Art

The prior art includes a pompon attached to one or more of the fingers by a compressible or deformable plastic sheath whereby the strips of material are combined at one common end. Offen, U.S. Pat. No. 4,369,215. The disadvantage of such an attachment means is certain acrobatic maneuvers cannot be accomplished since the pompon is essentially an extension of the finger, and thus would interfere with such maneuvers or stunts. Herkimer, U.S. Pat. No. 3,560,313 discloses strips of material combined at one common end, but in this case the bound end comprises a handle which requires the pompon to be held by a clenched hand. Again, the disadvantage is that the cheerleader is precluded from performing with the pompon during certain acrobatic maneuvers, and a spectator will have to place the pompon in his or her lap or under the seat to write in a scorecard or to eat. Barry, U.S. Pat. No. 2,810,977 discloses a pompon at the end of a stick that again must be actively held by the cheerleader or spectator thereby restricting certain activities. Bowers, U.S. Pat. No. 1,395,033 discloses a pompon used as an ornamental device. The pompon is comprised of strips of material bound together near their center, and a rigid clip is used to force the strips in a hemispheric shape. The invention is often much smaller than a traditional pompon and is generally attached to an article of clothing, such as a boot or ski cap, for decorative purposes.

The present invention overcomes the disadvantage of the prior art since a cheerleader, dancer, or spectator does not actively hold the pompon. This allows the cheerleader, dancer, or spectator to utilize and exhibit the pompon during all stunts or dance maneuvers without interference. The invention discloses a pompon that is attached to the back of the hand by an elastic band compressed against a finger. Thus a cheerleader or dancer can do an unlimited assortment of acrobatic maneuvers while still displaying or waving the pompon. The spectator can clap or eat while still displaying or waving the pompon. The improved pompon can be attached to other parts of a person's body as well, including but not limited to, the wrist, arm, ankle, or leg.

SUMMARY OF THE INVENTION (DISCLOSURE OF THE INVENTION)

The invention is of a self-securing pompon comprising a plurality of strands of material secured together by a compressive clasp or binder. Attached to the clasp or binder is a loop of elastic material. The diameter of the loop approximates the size of the body part to which the pompon is to be attached. Alternatively, the size of the loop could be adjusted to approximate the size of the body part to which it is to be attached with an adjusting clip. For example, the pompon can be attached to a finger, or any portion of the arm or leg via the elastic loop. The pompon can be used by cheerleaders, dancers, or spectators without restricting other activities. The pompon is constructed to assure ease in handling and extra comfort when performing.

A primary object of the present invention is to allow a cheerleader, dancer, or spectator to utilize the pompon without restricting any other function normally undertaken during use of the invention. Some of the uses include displaying or exhibiting the pompon at a parade, sporting event, or a political rally.

A primary advantage of the present invention is to provide an easily constructed and economical sports and entertainment device. The invention can be manufactured with a choice of materials dependent upon its use. Although relatively durable pompons can be constructed with waterproof plastic materials of various colors, a disposal type can be constructed with colored paper. The method of construction and the use of certain materials would allow the spectator to use the invention and then dispose of it after the event. The materials chosen for the invention may also be biodegradable.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated into and form a part of the specification, illustrate several embodiments of the present invention and, together with the description, serve to explain the principles of the invention. The drawings are only for the purpose of illustrating a preferred embodiment of the invention and are not to be construed as limiting the invention. In the drawings.

DESCRIPTION OF THE PREFERRED EMBODIMENTS

Figure 1:
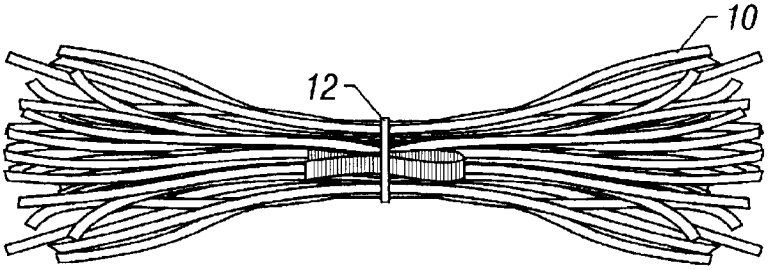
FIG. 1 is a representation of a plurality of strands 10 secured at a common point intermediate of their ends by a compressive clasp 12.
Figure 2:
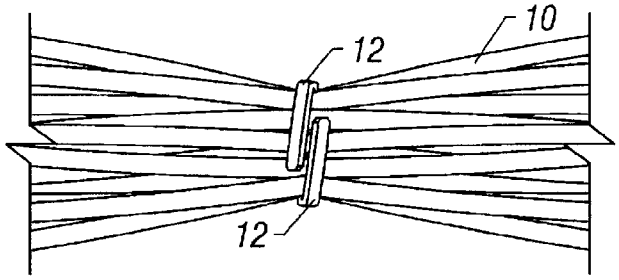
FIG. 2 is a representation of a plurality of strands 10 secured at a common point at one end of each strand by a compressive clasp 12.
Figure 3:
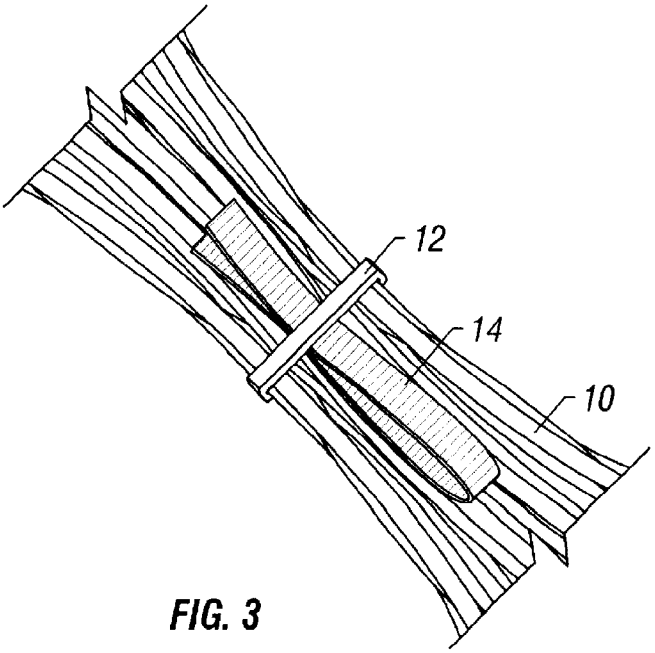
FIG. 3 is a representation of a plurality of strands 10 and a loop 14 secured at a common point by a compressive clasp 12.

The present invention is of a self-securing pompon comprising a plurality of strands of material 10 of variable color, reflective properties, length and width secured together by a compressive clasp or binder 12. The plurality of strands 10 are compressed or bound together intermediate of their ends or at a common end, as shown in FIGS. 1 and 2, respectively. Attached to the clasp or binder is a loop of material 14, preferably elastic. The diameter of the loop preferably approximates the size of the body part to which the pompon is to be attached. Alternatively, the size of the loop 14 may be adjusted to approximate the size of the body part to which it is to be attached with an adjusting clip (not shown). The loop 14 can be attached to the clasp 12 in a number of ways, including but not limited to, use of an adhesive material or securing the loop along with the strands with the compressive clasp or binder 12, as shown in FIG. 3. In this case a loop 14 is formed by securing the open ends of the material with the clasp or binder. Alternatively, an elongated strip of tape can be placed through an already established loop, and the ends of the tape are secured to the clasp or binder 12.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A pompon comprising a plurality of strands of material secured at a common point and an elastic loop of material attached at said common point, wherein said elastic loop of material is compressed against a finger of a user when said pompon is attached to a back of a hand of the user.

2. The pompon of claim 1 wherein said strands and said loop are secured by a compressive clasp.

3. A pompon comprising a plurality of strands of material and an elastic loop of material attached to one or more of said plurality of strands, wherein said elastic loop of material is compressed against a finger of a user when said pompon is attached to a back of a hand of the user.

4. The pompon of claim 3 wherein said loop is attached via a compressive clasp surrounding said strands.

* * * * *